US006509517B1

(12) United States Patent
Wroblewski

(10) Patent No.: US 6,509,517 B1
(45) Date of Patent: Jan. 21, 2003

(54) GRAND PIANO ACTION

(76) Inventor: Richard Wroblewski, 701 Silver La., Trumbull, CT (US) 06611

( * ) Notice: Subject to any disclaimer, the term of this patent is extended or adjusted under 35 U.S.C. 154(b) by 48 days.

(21) Appl. No.: 09/589,538

(22) Filed: Jun. 8, 2000

(51) Int. Cl.[7] ..... G10C 3/00
(52) U.S. Cl. ..... 84/216; 84/217
(58) Field of Search ..... 84/216, 215, 217, 84/218, 219, 221, 223, 224

(56) References Cited

U.S. PATENT DOCUMENTS 4,879,939 A * 11/1989 Wall ..... 84/240
5,511,454 A * 4/1996 Jones et al. ..... 84/236

* cited by examiner

*Primary Examiner*—Robert E. Nappi
*Assistant Examiner*—Kim Lockett

(57) ABSTRACT

An improvement for a conventional grand piano action to position a piano hammer at varying at rest positions to evoke varying intensities of sound with an unvarying strength of piano key touch.

27 Claims, 7 Drawing Sheets

GRAND PIANO ACTION

BACKGROUND

In conventional grand pianos in order to effect a softer tone the pianist utilizes a soft pedal, shifting the key board to a side of the piano directing piano hammers to strike fewer strings, this maneuver impoverishes the grand piano tone, and with very little softness as the piano hammers are substantially away at a fixed proximity in respect to the tensioned strings, the use of the soft pedal reflects the recognition of lack of sensitivity of the conventional grand piano action arrangement, to effect this softness the pianist even with the use of the soft pedal depresses the piano key with a light touch to effect any degree of softness as the piano hammers are striking the tensioned strings from a fixed proximity, making it difficult if not impossible to play pianissimo presto.

Except for the limits of lightly touching a piano key and pounding the piano key with great force together with the use of the soft pedal to soften the sound, expressions of intermediate degrees of loudness or softness are substantially impossible to evoke from conventional grand pianos. Because the piano hammers are striking the tensioned strings from a conventional fixed proximity, -a fortissimo proximity.

Varying degrees of pianissimo with a substantially unvarying strength of piano key touch is impossible in conventional acoustic pianos.

SUMMARY

In the conventional grand piano action the hammer shank carrying the piano hammer is connected pivotally to a hammer shank flange, a stationary member. In the improvement the hammer shank is connected pivotally to a lever, to elevate the hammer shank to position the piano hammer at varying proximities in respect to a tensioned string by pivoting the hammer shank by a knuckle under the hammer shank resting on a repetition lever. The piano hammer is synchronized with the escapement let off button, dependent from a second lever to strike the tensioned string from varying proximities, from varying at rest positions, uniquely different from the conventional grand piano action propelling the piano hammer from the same fixed at rest position. This improvement controls the volume of sound by a pedal directing the piano hammer to strike the tensioned string from any proximity to the tensioned string evoking varying volumes of sound with an unvarying strength of piano key touch.

OBJECTS

A primary object is to provide a piano key action mechanism permitting sensitive and controlled playing of pianissimo and other variations of touch.

Another object is to provide a piano key mechanism capable of evoking a wide dynamic range lacking in present day piano actions.

Another object is to eliminate or obviate dependence on the need for the conventional soft pedal.

Another object is to improve grand piano tone by having a piano hammer strike every string assigned to the piano hammer, not relying on the conventional soft pedal degrading grand piano tone.

Another object is to enable the pianist to play pianissimo with a normal piano key touch.

Another object is to install the improvement into grand pianos currently in use.

Another object is to provide a piano key action mechanism to propel piano hammers from selected proximities to produce a sensitive and controlled wide dynamic range.

Another object is to enable the pianist to play pianissimo presto with a normal piano key touch without missing notes.

Another object is to elevate selectively a piano hammer close to a piano string to evoke a whispering pianissimo with a substantially normal piano key touch.

Another object is to enable the pianist to practice wthout disturbing with a normal piano key touch.

DETAILED DESCRIPTION OF THE DRAWINGS

FIG. 1 in a side view illustrates a conventional grand piano action.

FIG. 2 in a side view illustrates a lever 4 supported by a first fulcrum 8, the lever 4 connecting pivotally to a proximal end of a hammer shank 2.

FIG. 3 in a side view illustrates the lever 4 supported by an adjustable fulcrum 8A.

FIG. 4 in a side view illustrates two levels of the stationary member 10.

FIG. 5 in a side view illustrates a knuckle 3 fixed to an adjustable screw 3A in an adjustable stage 3B on the hammer shank 2.

FIG. 5A in a side view illustrates the adjustable screw 3A in the hammer shank 2 carrying the knuckle 2.

FIG. 5B in a side view illustrates the knuckle 3 carried by the hammer shank 2 made from a spring means having one end free.

FIG. 5C in a side view illustrates a lifting surface 2A of the hammer shank 2 free of the knuckle 3 being covered with appropriate material 2C.

FIG. 6 in a side view illustrates diagrammatically a lever 6A connected pivotally to the stationary member 10 adjoining an inverted adjustable fulcrum 8B, the lever 6A connecting pivotally to the hammer shank 2.

FIG. 7 in a side view illustrates the hammer shank 2 being free of the knuckle 3, and the repetition lever 14 having a rounded portion 14A.

DESCRIPTION OF THE EMBODIMENTS

FIG. 1 illustrates a conventional grand piano action. A rail 10D supporting a flange 10, in the improvement it is a stationary member 10, a hammer shank 2 is pivotally connected to the flange 10, the hammer shank 2 is carrying a piano hammer 1, and a knuckle 3, the knuckle 3 is resting on a repetition lever 14, the repetition lever 14 is pivotally connected to a wippen 15, the wippen 15 is connected pivotally to a flange 10E, the flange 10E is fixed to a rail 10D, a jack 11 and arm 12 is connected pivotally to the wippen 15, a spring 11A is pressing against the repetition lever 14 and the arm 12 of the jack 11, a regulating button 9C is holding the jack 11 in position, a regulating button 9B and screw 19 is holding the repetition lever 14 in position, a rod 9 is carrying an escapement let off button 9A. On depressing a piano key 13 the jack 11 in an opening in the repetition lever 14 lifts the hammer shank 2 by the knuckle 3. Just before the piano hammer 1 strikes a tensioned string 16 the arm 12 of the jack 11 comes into contact with the escapement let off button 9A, forcing jack 11 away of the knuckle 3. and the hammer shank 2 rebounds onto a back chek 17 and upon releasing the piano key 13 the hammer shank 2 lands on a rest 20 and the knuckle 3 falls back on the repetition lever 14.

FIG. 2 illustrates a first embodiment of the improvement for a conventional grand piano action wherein a grand hammer shank being elevated by a lever connected pivotally to a proximal end of the grand hammer shank in cooperation with a knuckle of the grand hammer shank. The grand hammer shank being pivoted by the knuckle resting on a repetition lever of the conventional grand piano action permitting elevation of the grand hammer shank.

A stationary member 10 is fixed to a rail 10D, a grand hammer shank 2 carrying a piano hammer 1 and a knuckle 3, the grand hammer a shank 2 is pivotally connected to a first end of a lever 4, a second end of the lever 4 is pivotally connected to a first end of a control member 5, a second end of the control member 5 connecting to a pedal 5A, the lever 4 is pivoted by a fixed fulcrum 8, an adjustable fulcrum 8A is carrying a lever 6, a first end of the lever 6 is pivotally connected to a rod 9 carrying an escapement let off button 9A, a second end of the lever 6 is pivotally connected to the control member 5. On depressing the pedal 5A the control member 5 lifting the lever 4 together with the lever 6, the lever 4 depressing the proximal end of the grand hammer shank 2 carrying the piano hammer 1, the grand hammer shank 2 being elevated by the lever 4 by being pivoted by the knuckle 3 resting on the repetition lever 14, the piano hammer 1 being elevated toward a tensioned string 16, and at the same instant the control member 5 lifting the lever 6 pivoted by the adjustable fulcrum 8A and the lever 6 depressing the rod 9 carrying the escapement let off button 9A, moving the escapement let off button 9A close to an arm 12 of a jack 11, when the escapement let off button 9A contacts the arm 12 of the jack 11 the jack 11 disengages from the knuckle 3 just before the piano hammer 1 strikes the tensioned string 16 from a selected proximity.

FIG. 3 illustrates a second embodiment of the improvement. The lever 4 being supported by an adjustable fulcrum 8B, the escapement let off button 9A being adjustable along a threaded portion of the rod 9. The fulcrum/lever combination synchronizing proximity of the piano hammer 1 in respect to the tensioned string 16, together with proximity of the escapement let off button 9A in respect to the arm 12 of the jack 11, synchronizing disengagement of the jack 11 from the knuckle 3. When the escapement let off button 9A comes in contact with the arm 12 of the jack 11, the jack 11 disengages from the knuckle 3, just before the piano hammer 1 strikes the tensioned string 16 from different proximities, selected by the pedal 5A.

FIG. 4 illustrates diagrammatically an improvement for a grand piano action in a third embodiment. A stationary member 10, a grand hammer shank 2, carrying a piano hammer 1 and a knuckle 3, the hammer shank 2 is pivotally connected by its proximal end to a first end of a lever 4, a second end of the lever 4 is pivotally connected to a first end of a control member 5, a second end of the control member 5 connecting to a pedal 5A, the lever 4 is pivoted by an adjustable fulcrum 8A, the stationary member 10 having two open holes, a horizontal bridge 10A having two legs 10B the two legs 10B occupying the two holes in the stationary member 10, the lever 4 carrying an adjustable slide 4A, the adjustable slide 4A connecting to the horizontal bridge 10A to slide adjustably along the horizontal bridge 10A, one leg 10B of the horizontal bridge 10A carrying an escapement let off button 9A, the adjustable slide 4A regulating synchronization with the adjustable fulcrum 8A to position the piano hammer 1 at the proper distance from tensioned strings 16, and to position the let off button 9A at the proper distance to an arm 12 of a jack 11. When the arm 12 of the jack 11 comes in contact with the escapement let off buttob 9A the jack 11 disengages from the knuckle.

FIG. 5 illustrates diagrammatically a fourth embodiment of the improvement. A stationary member 10, a grand hammer shank 2 carrying a piano hammer 1 and a knuckle 3, the grand hammer shank 2 is pivotally connected by its proximal end to a first end of a lever 4 and a second end of the lever 4 is pivotally connected to a first end of a control member 5, a second end of the control member 5 connecting to a pedal 5A, the lever 4 is pivoted by an adjustable fulcrum 8A, the stationary member 10 having an open channel 10C, a rod 9 carrying an escapement let off button 9A, the rod 9 being in an open hole in an adjustable stage 9C, the adjustable stage 9C to be adjustably moved along the stationary member 10, moving the rod 9 in the open channel 10C in the stationary member 10, the rod 9 carrying the escapement let off button 9A depending from the lever 4 pivotally connected to the proximal end of the grand hammer shank 2, the escapement let off button 9A being adjustable along a threaded portion of the rod 9. The adjustable stage 9C being adjustably positioned to the stationary member 10 by a spring 9D fastened to underside of the stage 9C, the spring 9D pressing against sides of the open channel 10C holding the adjustable stage 9C in position on said stationary member 10.

FIG. 5A illustrates diagrammatically a fifth embodiment of the improvement. A stationary member 10 supporting an adjustable fulcrum 8A, the adjustable fulcrum 8A supporting a lever 4, a first end of the lever 4 pivotally connecting to a proximal end of a grand hammer shank 2, a rod 9 carrying an escapement let off button 9A, the rod 9 depending from a portion of the first end of the lever 4, a pedal 5A connecting to a second end of the lever 4, The rod 9 carrying the escapement let off button 9A being in an open hole in the stationary member 10. The escapement let off button 9A being above arm 12 of jack 11, jack 11 being in contact with knuckle 3, the knuckle 3 attached to grand hammer shank 2.

FIG. 6 illustrates diagrammatically a third embodiment of the improvement. A stationary member 10 supporting an adjustable fulcrum 8A. the adjustable fulcrum 8A supporting a first lever 4, a first end of the first lever 4 carrying an adjustable inverted fulcrum 8B. the adjustable inverted fulcrum 8B adjoining a second lover 6A, a first end of the lever 6A pivotally connecting to a proximal end of a grand hammer shank 2, a second end of the lever 6A pivotally connecting to the stationary member 10, a second end of the first lever 4 connecting to a pedal 5A, a rod 9 carrying an escapement let off button 9A depending from the first lever 4. The adjustable fulcrum 8A to be adjusted with the adjustable inverted fulcrum 8B synchronizing position of a piano hammer carried by a distal end of the grand hammer shank 2 under a tensioned string, and position.of the escapement let off button 9A above an arm 12 of a jack 11 on depressing the pedal 5A.

The adjustment of the fulcrums 8A and 8B regulating pivoting ratio between the levers 4 and 6A, thereby synchronizing movement of the piano hammer with movement of the escapement let off button 9A. When the escapement let off button comes in contact with the arm 12 of the jack 11, the jack 11 disengages from a knuckle 3 carried by the grand hammer shank 2, just before the piano hammer strikes the tensioned string.

FIG. 4 illustrates a fourth embodiment of the improvement. A stationary member 10 having two levels, an upper level of the stationary member 10 carrying a first adjustable fulcrum 8A, the first adjustable fulcrum 8A carrying a first lever 4, a first end of the first lever 4 pivotally connecting to a proximal end of a grand hammer shank 2, the grand hammer shank 2 carrying a knuckle 3, a second end of the first lever 4 pivotally connecting to a control member 5, the control member 5 connecting to a pedal 5A.

A lower level of the stationary member 10 carrying a second adjustable fulcrum 8A, the second adjustable fulcrum 8A carrying a second lever 6, a first end of the lever 6 pivotally connecting to a rod 9, the rod 9 carrying an escapement let off button 9A, a second end of the lever 6 connecting to the control member 5.

Figure 7:
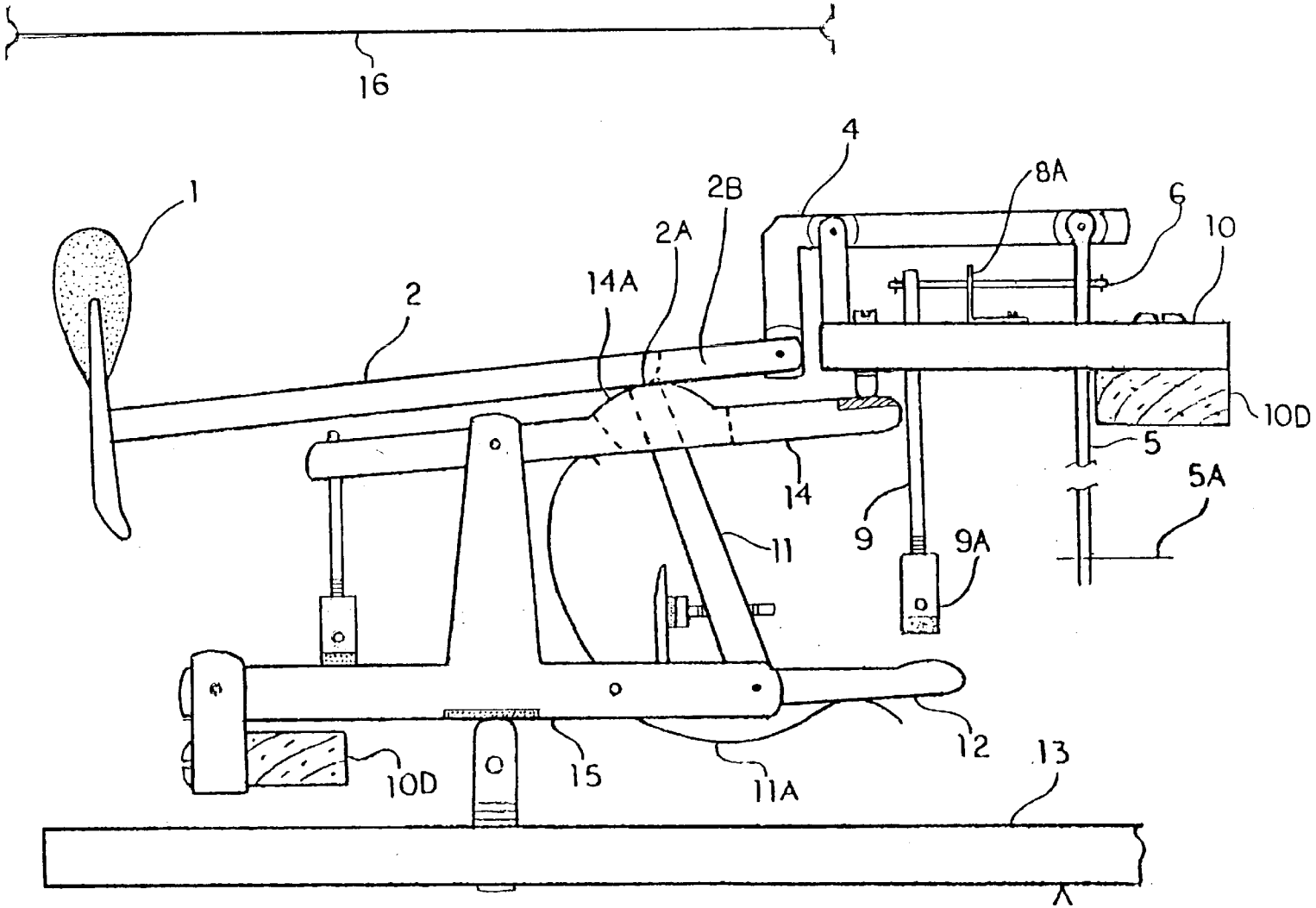

FIG. 7 illustrates in a side view a fifth embodiment of the improvement, the knuckle 3 carried by the grand hammer shank 2 cooperating with the lever 4 to elevate the grand hammer shank 2 is eliminated, a rounded portion 14A on the repetition lever 14 is cooperating with the lever 4 to elevate the grand hammer shank 2. The jack 11 on lifting the grand hammer shank 2 by a lifting surface 2A into an opening 2B in the grand hammer shank 2.

Figure 1:
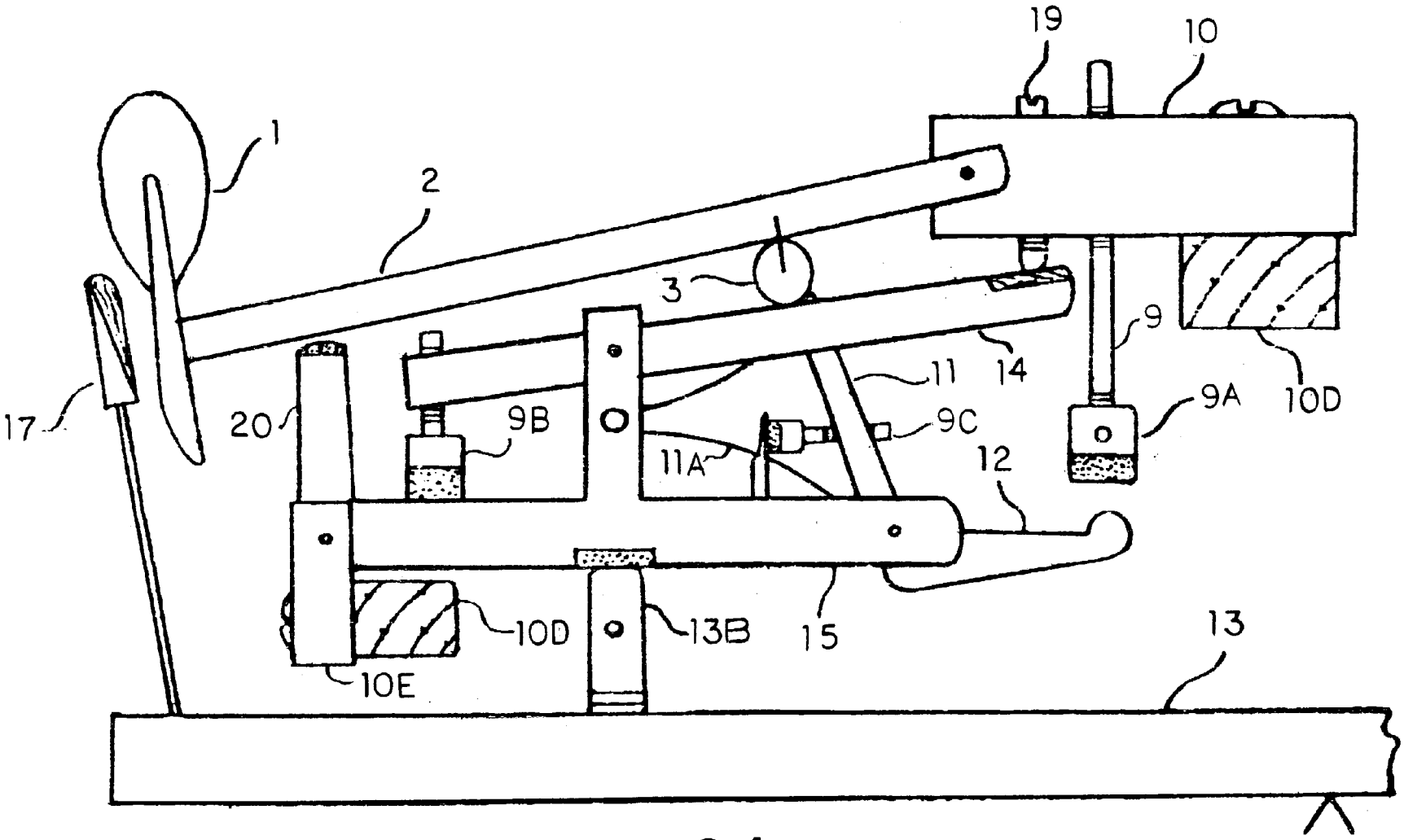
FIG. 1 PRIOR ART
Figure 2:
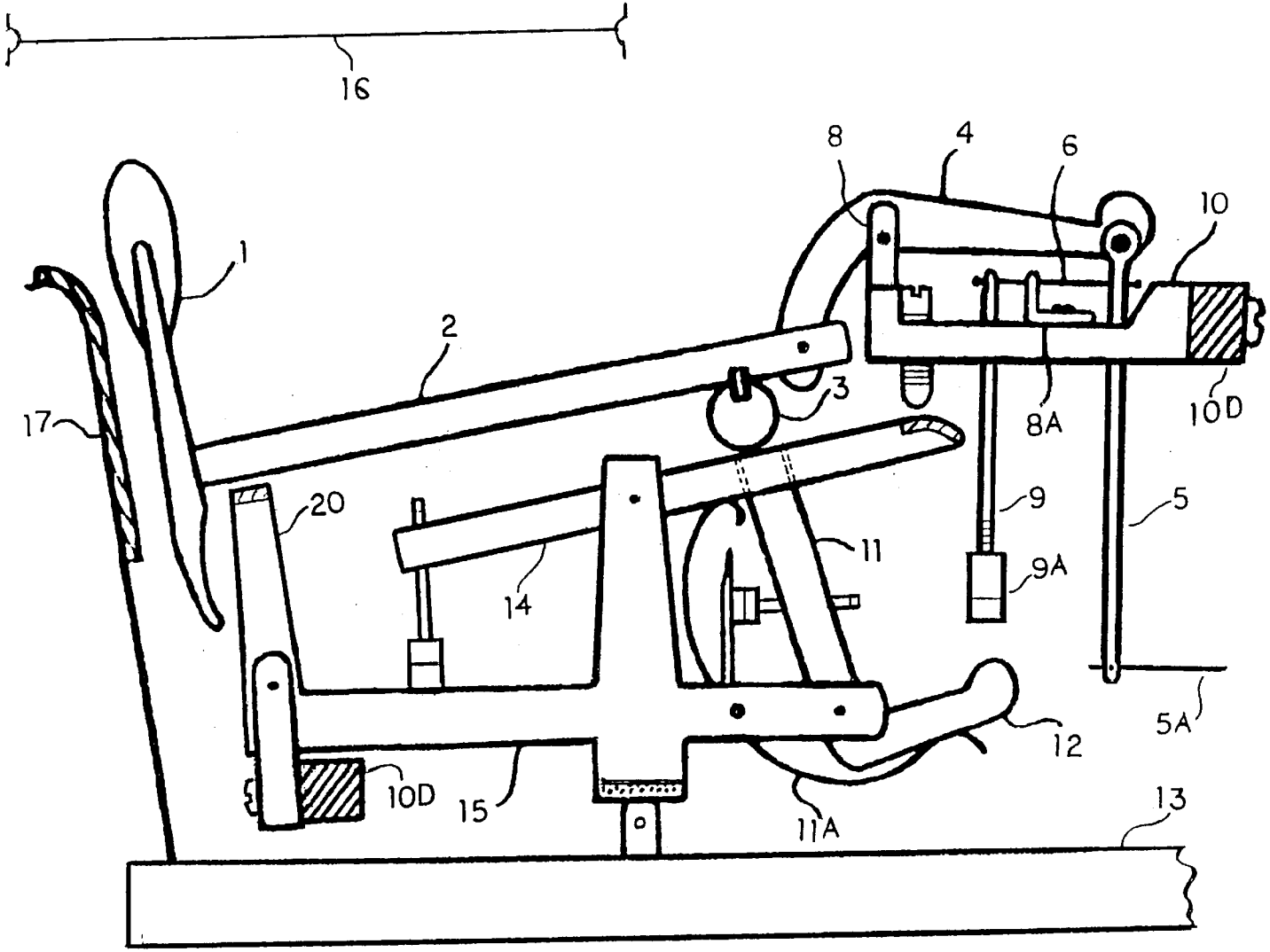
Figure 3:
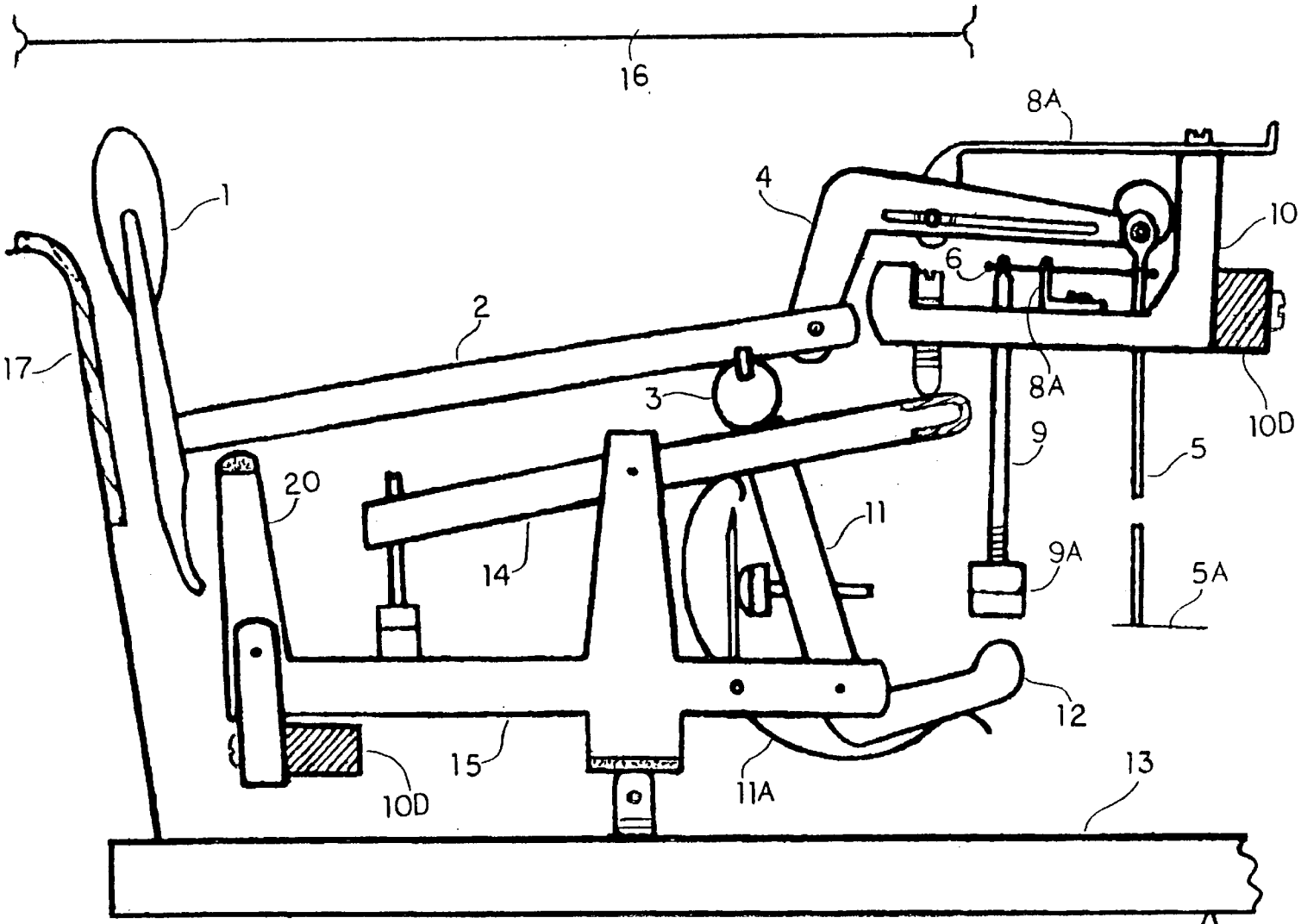
Figure 4:
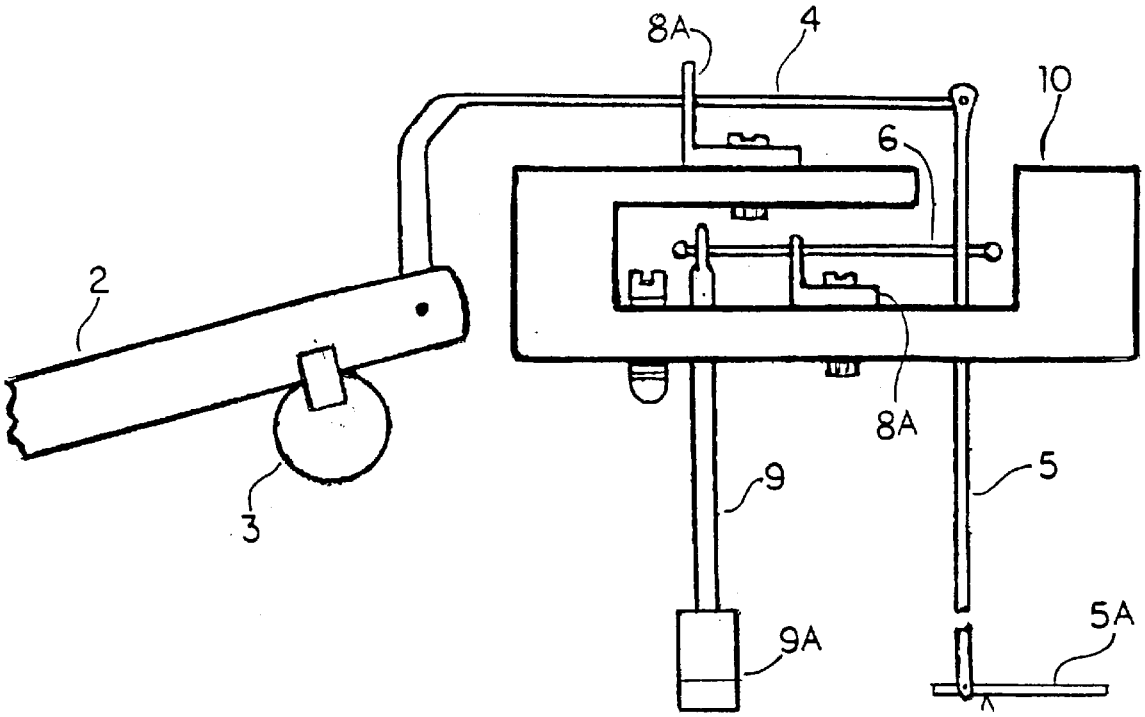
Figure 5:
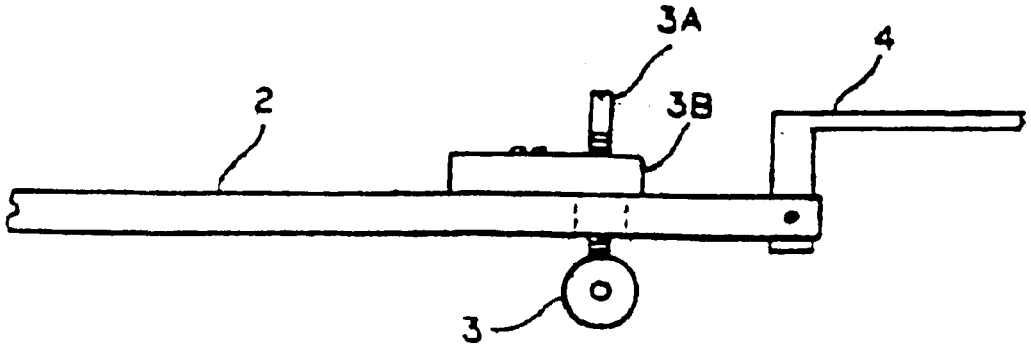
FIG. 5 illustrates in a side view the knuckle 3 being adjustable along the grand hammer shank 2 by an adjustable stage 3B carrying screw 3A.
Figure 5A:
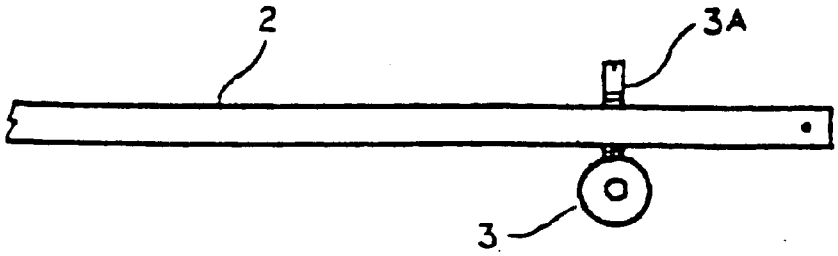
FIG. 5A illustrates the knuckle 3 being adjustable across the hammer shank 2.
Figure 5B:
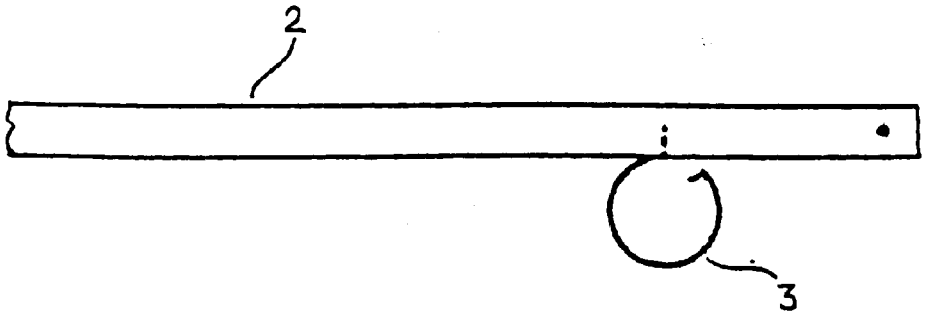
FIG. 5B illustrates in a side view the knuckle 3 being a spring means.
Figure 5C:
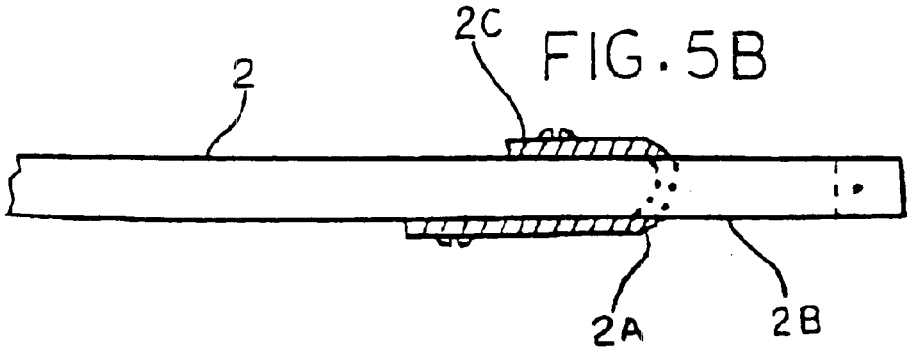
Figure 6:
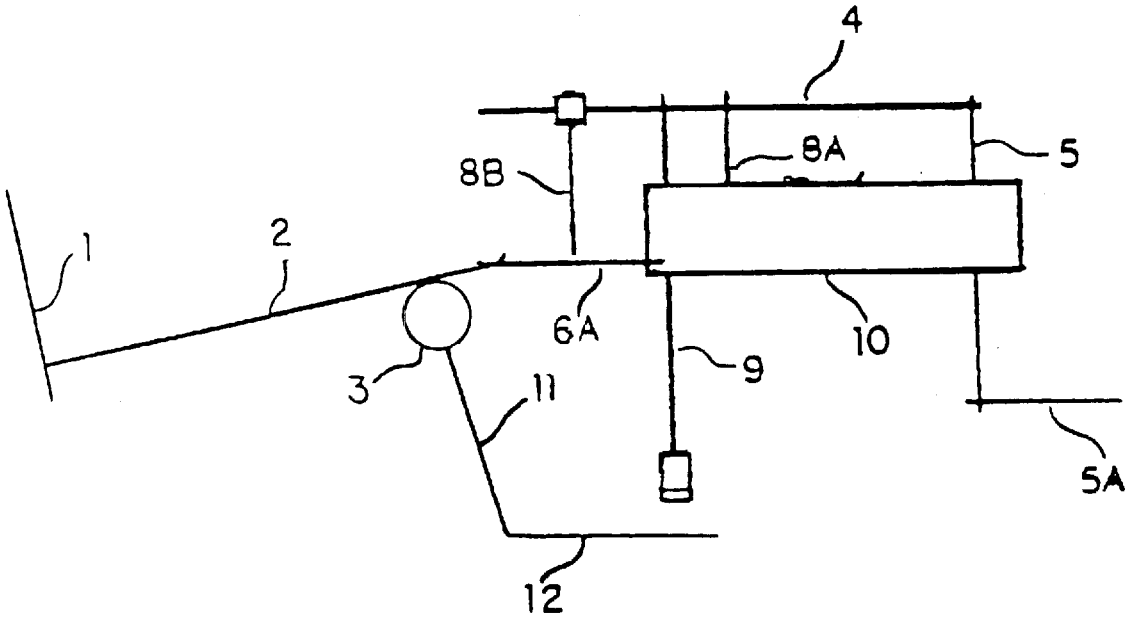

FIG. 5C illustrates the lifting surface 2A being covered with an appropriate material 2C.

I claim:

1. An improvement for a grand piano action comprising a stationary member fixed to a rail, a grand hammer shank connected pivotally to a lever supported by a fulcrum on said stationary member, said grand hammer shank being pivotable by a knuckle carried by said grand hammer shank, said knuckle pivoting on a repetition lever of said grand piano action by said lever connected pivotally to said grand hammer shank, said lever pressing down on said grand hammer shank, thereby elevating a piano hammer carried by said grand hammer shank by a pedal connected to an opposite end of said lever connected pivotally to said grand hammer shank, a rod carrying an escapement let off button depending from a second lever, supported by a second fulcrum on said stationary member, said second lever connecting to said pedal.

2. An improvement for a grand piano action according to claim 1 wherein said escapement let off button being adjustable along a threaded portion of said rod carrying said escapement let off button.

3. An improvement for a grand piano action according to claim 1 wherein said fulcrum on said stationary member being adjustable along said stationary member.

4. An improvement for a grand piano action according to claim 3 wherein said stationary member supporting a second adjustable fulcrum, said second adjustable fulcrum supporting a second lever, a rod carrying an escapement let off button depending from a first end of said second lever, a second end of said second lever being connected to a pedal.

5. An improvement for a grand piano action according to claim 2 wherein said escapement let off button being as justable along said threaded portion of said rod carrying said escapement let off button,-said escapement let off button facing an arm of a jack, said rod carrying said escapement let off button depending from a lever carried by a stationary member through a hole in said stationary member.

6. An improvement for a grand piano action according to claim 1 wherein said lever connected to said grand hammer shank and said escapement let off button depending from said second lever cooperating in a synchronous manner to produce an expanded dynamic range of grand piano tone.

7. An improvement for a grand piano action according to claim 1 wherein said pedal elevating said grand hammer shank carrying said piano hammer to different selected at rest positions for said piano hammer to strike a tensioned string from different proximities to evoke different selected volumes of grand piano tone with a substantially invariable strength of piano key touch.

8. An improvement for a grand piano action according to claim 4 wherein said adjustable fulcrums regulating pivoting ration between said levers supported by said adjustable fulcrums in a synchronous manner, moving synchronously said escapement let off button toward an arm of a jack and moving synchronously a piano hammer toward a tensioned string effectuating said piano hammer to strike said tensioned string from different selected at rest positions.

9. An improvement for a grand piano action according to claim 1 wherein said lever supported by said fulcrum positioned on said stationary member having an adjustable inverted fulcrum depending from said lever supported by said fulcrum positioned on said stationary member; said adjustable inverted fulcrum adjoining a lever connecting said hammer shank to said stationary member; said escapement let off button depending from said lever supported by said fulcrum positioned on said stationary member; said lever supported by said fulcrum positioned on said stationary member connecting to a pedal.

10. An improvement for a grand piano action according to claim 9 wherein said stationary member having two holes, two legs of a bridge occupying said two holes, and one leg carrying said escapement let off button, said bridge being slidably connected to said inverted fulcrum, slidably depending from said lever supported by said fulcrum positioned on said stationary member.

11. An improvement for a grand piano action according to claim 1 wherein said rod carrying said escapement let off button depending from said lever supported by said fulcrum positioned on said stationary member being in an open channel in said stationary member, said rod carrying said escapement let off button being in a hole of a spring means, said spring means being adjustable along said stationary member held by sides of said open channel in said stationary member.

12. An improvement for a grand piano action according to claim 1 wherein said grand hammer shank connected pivotally to said lever being pivotable by an elongated member protruding through said grand hammer shank; said elongated member pivoting on said repetition lever of said grand piano action by a pedal lifting an opposite end of said lever.

13. An improvement for a grand piano action according to claim 12 wherein said elongated member being adjustable across said grand hammer shank to elevate said hammer shank.

14. An improvement for a grand piano action according to claim 12 wherein to said elongated member being attached a rounded spring means, one end of said rounded spring means being free, said rounded spring means resting on said repetition lever of said grand piano action to be lifted by said jack.

15. An improvement for a grand piano action according to claim 14 wherein said rounded spring means being covered with an appropriate material.

16. An improvement for a grand piano action wherein a stationary member having two levels, a first level supporting a first fulcrum, said first fulcrum supporting a first lever, said first lever connecting pivotally to a grand hammer shank, a second level of said stationary member under said first level of said stationary member supporting a second fulcrum, said second fulcrum supporting a second lever, a first end of said second lever connecting pivotally to a rod carrying a escapement let off button, a second end of said second lever together with a second end of said first lever connecting pivotally to a control member, said control member connecting to a pedal.

17. An improvement for a grand piano action according to claim 16 wherein said first fulcrum on said first level of said stationary member being adjustable along said first level of said stationary member.

18. An improvement for a grand piano action according to claim 16 wherein said second fulcrum on said second level of said stationary member being adjustable along said second level of said stationary member.

19. An improvement for a grand piano action according to claim 16 wherein said escapement let off button being adjustable along a threaded portion of said rod carrying said escapement let off button.

20. An improvement for a grand piano action according to claim 1 wherein said knuckle being a spring means, one end of said spring means being free.

21. An improvement for a grand piano action according to claim 20 wherein said knuckle of said spring means being covered with appropriate material.

22. An improvement for a grand piano action according to claim 1 wherein said grand hammer shank carrying an adjusting screw, and to said adjusting screw being fixed said knuckle.

23. An improvement for a grand piano action wherein a piano hammer carried by a grand hammer shank being elevated to different levels in respect to a tensioned string by said grand hammer shank being pivoted by a knuckle carried by said grand hammer shank on a repetition lever in cooperation with a lever connected to said grand hammer shank, connecting to a pedal; said lever pressing down on said grand hammer shank; positioning said piano hammer at said different levels, in different at rest positions in said respect to said tensioned string; to evoke different levels of sound; with an unvarying strength of piano key touch.

24. An improvement for a grand piano action according to claim 1 wherein said stationary member supporting said second fulcrum, said second fulcrum supporting said second lever, said rod carrying said escapement let off button depending from a first end of said second lever, and a second end of said second lever connecting to said pedal to lift said second end of said second lever.

25. An improvement for a grand piano action according to claim 1 wherein said grand hammer shank connected to said lever supported by said fulcrum on said stationary member being free of said knuckle; said grand hammer shank resting on a protuberance on a repetition lever; said grand hammer shank pivoting on said protuberance of said repetition lever by said lever connected to said grand hammer shank pressing down on said grand hammer shank, thereby elevating said piano hammer carried by said grand hammer shank by said pedal connecting to said opposite end of said lever connected to said grand hammer shank; said rod carrying said escapement let off button depending from said second lever; said grand hammer shank having an opening in said grand hammer shank for a jack lifting said grand hammer shank to escape into said opening in said grand hammer shank.

26. An improvement for a grand piano action according to claim 25 wherein said opening in said grand hammer shank permitting said jack to escape into said opening in said grand hammer shank extending from a lifting surface of said grand hammer shank to a pivot axis of said grand hammer shank.

27. An improvement for a grand piano action according to claim 26 wherein said lifting surface of said grand hammer shank next to said opening in said grand hammer shank may be covered with an appropriate material.

* * * * *